United States Patent [19]

Takano et al.

[11] 4,406,971

[45] Sep. 27, 1983

[54] COLOR CATHODE RAY TUBE HAVING A REFERENCE WHITE FLUORESCENT SCREEN

[75] Inventors: Yutaka Takano; Koji Yajima; Takashi Ishii; Tadahisa Yoshida; Katsuhiro Ota, all of Nagaokakyo; Shigeru Yagishita, Yokohama, all of Japan

[73] Assignees: Mitsubishi Denki Kabushiki Kaisha; Fuji Telecasting Co., Limited, both of Tokyo, Japan

[21] Appl. No.: 56,560

[22] Filed: Jul. 11, 1979

Related U.S. Application Data

[63] Continuation of Ser. No. 913,323, Jun. 7, 1978, abandoned, which is a continuation-in-part of Ser. No. 874,692, Feb. 2, 1978, abandoned, which is a continuation-in-part of Ser. No. 679,442, Apr. 22, 1976, abandoned.

[30] Foreign Application Priority Data

| | | | |
|---|---|---|---|
| Apr. 20, 1976 | [DE] | Fed. Rep. of Germany | 2617195 |
| Apr. 22, 1976 | [NL] | Netherlands | 7604251 |
| Apr. 22, 1976 | [FR] | France | 7611910 |
| Apr. 23, 1976 | [GB] | United Kingdom | 16711/76 |

[51] Int. Cl.[3] ..... H01J 29/10

[52] U.S. Cl. ..... 313/461; 313/472; 358/10

[58] Field of Search ..... 313/401, 461, 462, 470, 313/471, 472; 358/10, 29

[56] References Cited

U.S. PATENT DOCUMENTS

| | | | |
|---|---|---|---|
| 2,337,980 | 12/1943 | Du Mont et al. | 313/461 X |
| 2,556,455 | 6/1951 | Szegho et al. | 313/461 X |
| 2,669,671 | 7/1954 | Headrick | 313/470 X |
| 2,823,254 | 9/1958 | Heuer et al. | 358/65 X |
| 2,842,697 | 7/1958 | Bingley | 313/471 |
| 2,854,505 | 8/1958 | Davis | 358/10 |
| 2,892,123 | 6/1959 | Sunstein | 313/471 X |
| 3,479,448 | 7/1969 | Kollsman | 358/29 |
| 3,763,310 | 10/1973 | Sagishima et al. | 358/10 |

OTHER PUBLICATIONS

"Optical Characteristics of Cathode Ray Tube Screens," JEDEC Publication No. 16-B; Aug. 1971; p. 120 cited.

*Primary Examiner*—Eugene R. La Roche
*Attorney, Agent, or Firm*—Oblon, Fisher, Spivak, McClelland & Maier

[57] ABSTRACT

A color cathode ray tube comprises a first fluorescent part on a part of an inner surface of a face plate and said first fluorescent part imparting a luminescence of a predetermining reference white color by irradiation of electron beams; a second fluorescent part on the remained part of the face plate and said second fluorescent part imparting red, green and blue fluorescent dots or stripes wherein the first fluorescent part for the reference white color is formed by a mixture or tricolor fluorescent materials for the second fluorescent part or a mixture of tricolor fluorescent materials which imparts a luminous spectrum being similar to that of the tricolor fluorescent materials for the second fluorescent part.

9 Claims, 4 Drawing Figures

COLOR CATHODE RAY TUBE HAVING A REFERENCE WHITE FLUORESCENT SCREEN

CROSS-REFERENCE TO RELATED APPLICATIONS

This Application is a continuation of U.S. application Ser. No. 913,323 filed June 7, 1978, which is a continuation-in-part of application Ser. No. 874,692 filed on Feb. 2, 1978, which is a continuation of application Ser. No. 679,442 filed on Apr. 22, 1976, and now abandoned.

BACKGROUND OF THE INVENTION

1. Field of the Invention

The present invention relates to a color cathode ray tube which is preferably used for broadcasting monitor. More particularly, it relates to a color cathode ray tube which is effective for adjusting white color balance.

2. Description of the Prior Art

In the case of adjusting white color balance of a color cathode ray tube for a video monitor used in broadcasting stations, the white color displayed on the screen of the color cathode ray tube should be precisely conformed with the predetermined reference white color. Otherwise, the images displayed on the screen impart different hue depending upon a broadcasting or a channel.

The reference white color for video monitors used in broadcasting stations are decided to be the specific white color having the predetermined color temperature. For example, in U.S.A and European countries, the reference white color is decided to a solar ray color D6500 (6550° K.+7MPCD) which is near the reference C light source (color temperature of 6740° K.) as the reference white color in the NTSC system or to the reference white color for the receivers (9300° K.+27MPCD).

In Japan, the reference white color for video monitors is decided to D9300 (9300° K.+8MPCD) which is near the reference white color for the receivers (9300° K.+27MPCD).

The white balance of the white color for the video monitors in broadcasting stations should be precisely adjusted to the decided reference white color. In the broadcasting stations, various white balance adjusting methods have been employed as follows.

(1) A method of color memorization by an operator (2) A method of using a white color balance control device (3) A method of comparing color with the reference white light source The first method of color memorization is not suitable method because of inferior accuracy and individual difference by operators.

The second method of using the white color balance control device is superior to the first method however, it has the disadvantages that a reference tube having the precise reference white color is used, and the memory module of the white color balance control device should be used depending upon the reference tubes and a routine calibration is needed and the maintenance is not easy whereby it is difficult to adjust white balance at desired times by the white color balance control device.

The third method of comparing with the reference white light source is effective for color adjustment in high accuracy in one sight color comparison however, when the monitor and the reference white light source are not in one sight but they are departed, this method has disadvantages that the accuracy for color adjustment is inferior and the reference white light source is usually expensive and the routine calibration is needed and the maintenance is not easy and the white color balance adjustments by this method at desired times are not easy. Accordingly, the third method is also not suitable for the white color balance adjustment.

The reference white light source used in the third method is prepared by combination of a light source and suitable filter, whereby the luminous spectrum is usually quite different from that of the white color of the color cathode ray tube for a video monitor.

In usual, when two light sources having different each luminous spectrum are combined to give an equivalent color, the accuracy of the color is remarkably inferior to that of the combination of light sources having the same luminous spectrum. Accordingly, the accuracy is not so high in the third method of white balance adjustment by using the reference white light source.

As described above, the conventional white balance adjustments have certain disadvantages and they are not optimum. It has been desired in the broadcasting fields to attain a white balance adjustment to the predetermined reference white color in high accuracy with a simple operation and by an easy operation.

SUMMARY OF THE INVENTION

It is an object of the present invention to overcome the above-mentioned disadvantages and to satisfy the demands and to provide a color cathode ray tube by which white balance adjustment can be simply attained in high accuracy at any optional time.

It is another object of the present invention to provide a color cathode ray tube by which white balance adjustment can be simply attained in high accuracy only by operating it without using a color temperature meter nor a colorimeter which overcomes the above-mentioned disadvantages.

It is the other object of the present invention to provide a color cathode ray tube which has a fluorescent part having novel structure so as to attain white balance adjustment in high accuracy.

The foregoing and other objects of the present invention can be attained by providing a color cathode ray tube comprising a first fluorescent part on a part of an inner surface of a face plate and said first fluorescent part imparting a luminescence of a predetermined reference white color by irradiation of electron beams; a second fluorescent part on the remained part of the face plate and said second fluorescent part imparting red, green and blue fluorescent tricolor dots or tricolor stripes.

The objects of the present invention can be attained by using a mixture of tricolor fluorescent materials for the second fluorescent screen or a mixture of tricolor fluorescent materials which imparts a luminous spectrum being similar to that of the tricolor fluorescent materials for the second fluorescent part as the first fluorescent part for the reference white color.

The objects of the present invention can be attained by providing the first fluorescent part for the reference white color and the second fluorescent part for red, green and blue fluorescent tricolor dots or tricolor stripes on one face plate so as to compare both fluorescent parts in one sight.

The objects of the present invention can be also attained by providing a light absorbing zone at the boundary between the first fluorescent part for the reference white color and the second fluorescent part for tricolor dots or tricolor stripes so as to improve the accuracy for comparing the colors on both of the fluorescent parts.

DETAILED DESCRIPTION OF THE PREFERRED EMBODIMENTS

Figure 1:
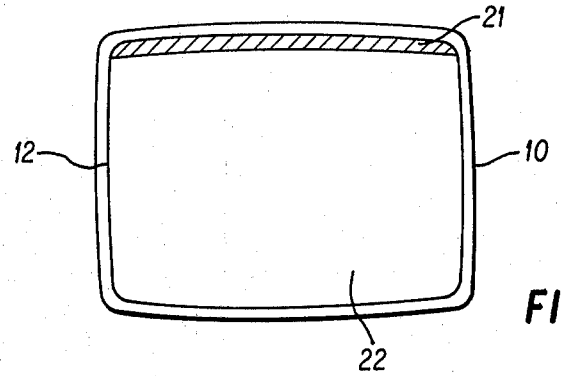
FIG. 1 is a schematic diagram of one embodiment of a color cathode ray tube of the present invention by a sight from the front of a face plate.

FIG. 1 is a schematic view of one embodiment of a color cathode ray tube of the present invention by a sight from the front of a face plate.

In FIG. 1, a screeen (12) of the color cathode ray tube (10) is partially divided into two kinds of fluorescent parts. That is, the screen (12) comprises the first fluorescent part (21) for luminescence of the reference white color and the second fluorescent part (22) for red, green and blue tricolor dots or tricolor stripes which is the same with the normal color cathode ray tube.

Three electron guns (not shown) are provided at a neck of the color cathode ray tube (10). The electron beams projected from the electron guns pass through holes of a shadow mask (not shown) disposed inside of the screen to the first fluorescent part (21) and the second fluorescent part (22) of the screen (12) whereby both of the fluorescent parts are irradiated to result luminescences.

The first fluorescent part (21) and the second fluorescent part (22) can be prepared by the slurry method and the other conventional methods for coating the fluorescent materials on the face plate of the normal color cathode ray tube. That is, the second fluorescent part (22) is formed by coating the fluorescent materials, exposing them and developing them. In the operation, the exposing step is carried out by shielding the part for the first fluorescent part (21) so as to prevent the exposure and the first fluorescent part (21) is formed by coating the fluorescent materials on the latter part and exposing under shielding the second fluorescent part (22) and developing them and then, the color cathode ray tube is prepared by the conventional methods.

The first fluorescent part (21) provided at a part of the screen (12) of the color cathode ray tube (10) imparts the predetermined reference white color (for example, D6500 or D9300 or 9300° K.+27 MPCD) by the irradiation of the electron beams under the predetermined condition.

The second fluorescent part (22) provided in the remained part of the screen (12) is formed by the red, green and blue tricolor dots or tricolor stripes as the conventional color cathode ray tube whereby optional mixed colors can be obtained by controlling the intensities of the electron beams injected to the fluorescent elements.

When the white balance adjustment is carried out by using the color cathode ray tube shown in FIG. 1, the white balance adjustment is attained by controlling the intensities of the electron beams given by the three electron guns so as to provide the white color of the second fluorescent part (22) to be the same with the reference white color of the first fluorescent part (21).

In the conventional method (3) for the white balance adjustment, that is, the color comparison with the reference white light source, it is difficult to compare them in one sight because the reference white light source is departed from the monitor color cathode ray tube for the white balance adjustment. Accordingly, both of the chromaticities in the different sights are instantaneously memorized to compare both of the memorized chromaticities in the different sights, whereby the accuracy of the color comparison is inferior.

On the other hand, in the case of the color cathode ray tube of the present invention, the predetermined reference white color is provided in the same screen whereby the color comparison can be attained in one sight and the accuracy is remarkably superior.

In the embodiment shown in FIG. 1, the first fluorescent part (21) for the reference white color is provided at the upper edge of the screen (12) whereby both of the first fluorescent part (21) and the second fluorescent part (22) are in one sight and the color comparison can be attained under simultaneously comparing both of the fluorescent parts and the accuracy of the color comparison is remarkably superior.

Figure 2:
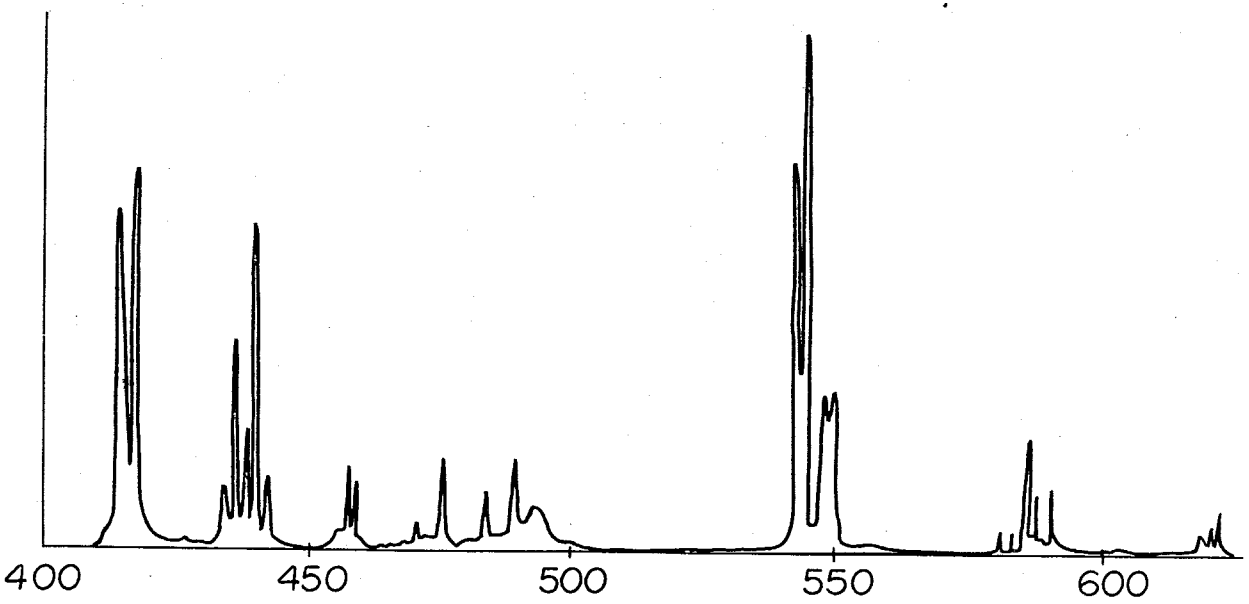
FIG. 2 is a luminous spectrum of P-45 fluorescent part for the reference white color for a color cathode ray tube according to the present invention.

The inventors have studied to prepare the first fluorescent part (21) for the reference white color of the color cathode ray tube by using P-45 fluorescent material whose luminous spectrum is shown in FIG. 2. The luminous spectrum of the P-45 fluorescent material is line spectra and the chromaticity point of the fluorescent materials is about 10750° K.+46MPCD. Accordingly, a small amount of the other fluorescent material is added to prepare the color cathode ray tube having the first fluorescent part (21) imparting a chromaticity point of D9300. When the color comparison for the second fluorescent part (22) with the white color of the first fluorescent part (21) of the color cathode ray tube has been tried, it has been found to be difficult to make the same white color. The reason is considered that the lumen efficiency of the P-45 fluorescent materials is remarkably smaller than that of the fluorescent materials of the second fluorescent part (22) and accordingly, the luminous intensity of the first fluorescent part (21) is remarkably dark in comparison with that of the second fluorescent part (22) and the luminous spectrum of the first fluorescent part (21) of said color cathode ray tube is quite different from that of the second fluorescent part (22).

In the color cathode ray tube of the present invention, the first fluorescent part (21) for the reference white color is formed by using the specific fluorescent materials suitable for overcoming the above-mentioned disadvantages.

In the embodiment of the present invention, the first fluorescent part (21) for the reference white color is formed by using the red, green and blue fluorescent materials used for the second fluorescent part (22) or the fluorescent materials imparting substantially the same luminous spectrum with that of the second fluorescent part (22) at suitable ratios whereby the luminous spectrum of the first fluorescent part (21) is substantially the same with that of the second fluorescent part (22) and the intensity of the first fluorescent part (21) can be substantially the same with that of the second fluorescent part (22) in the white balance adjustment. Accordingly, in the color comparison, the effect of the metamerism, that is, the similarity in color though the spectral distribution is different, is small to be high accuracy. This advantage is the most important one as the characteristic of the color cathode ray tube of the present invention.

When the tricolor dots or tricolor stripes of fluorescent materials for the second fluorescent part (22) are formed with rare earth fluorescent materials materials $Y_2O_3$:Eu as red and sulfide fluorescent materials (Zn, Cd) S:Cu:Al as green and sulfide fluorescent materials ZnS:Ag as blue, the first fluorescent part (21) for the reference white color is prepared by blending the fluorescent materials at the specific ratios into a homogeneous mixture as shown in the following examples, whereby the white balance adjustment can be easily attained in high accuracy.

EXAMPLE 1

In order to prepare a color cathode ray tube having a fluorescent part for the reference white color of D9300, the first fluorescent part for the reference white color was prepared by blending fluorescent materials for P-22 which are the same with those of the second fluorescent part (22) at the following ratios.

The red fluorescent materials $Y_2O_3$:Eu, the green fluorescent materials (Zn, Cd)S:Cu:Al and the blue fluorescent materials ZnS:Ag were blended at ratios of 1.0:0.95:0.81 and the resultant homogeneous mixture was coated by a slurry method. The luminous intensity of the first fluorescent part (21) could be adjusted substantially the same with that of the second fluorescent part (22) at the boundary under controlling the amount of the composition of the mixture coated.

The white balance adjustment was carried out by setting the anode voltage of 25 KV and the white color having the luminous intensity of 120 nt, where nt is a unit of luminance, equal to 1 candela per square meter and adjusting the beam current intensities of the electron beams for red, green and blue electron guns which are injected to the second fluorescent part (22).

The chromaticity point of the luminous chromaticity of the first fluorescent part for the reference white color (21) was measured by the luminous spectrum, under the above-mentioned condition. The fluorescent part for the reference white color was substantially the same with D9300 (9300° K.+8MPCD), where MPCD is the Minimum Perceptible Chromaticity Difference.

Figure 3:
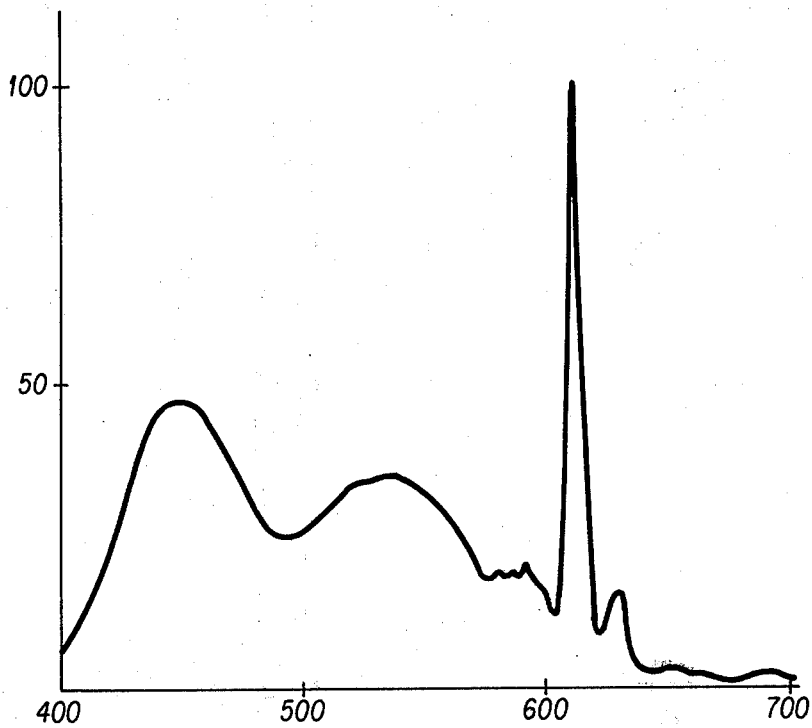
FIG. 3 is a luminous spectrum of a fluorescent part for the reference white color which is prepared by using P-22 mixture of red, green and blue fluorescent materials.

The luminous spectrum of the luminescence of the first fluorescent part (21) for the reference white color was as shown in FIG. 3, and it was substantially the same with the luminous spectrum of the second fluorescent part (22) after the white balance adjustment.

The difference between the luminous intensities of the first fluorescent part and the second fluorescent part was about 10% and the luminous intensities were substantially the same in appearance.

EXAMPLE 2

The fluorescent part for the reference white color of D6500, was prepared by blending fluorescent materials of the red fluorescent materials of $Y_2O_2S$:Eu; the green fluorescent materials of ZnS:Al:Cu, and the blue fluorescent materials of ZnS:Ag at ratios of 1.0:0.58:0.47 which were selected from the P-22 fluorescent materials.

In accordance with the method of Example 1, the luminous spectrum of the first fluorescent part (21) was measured and the chromaticity point was calculated to give substantially the same chromaticity point of D6500.

The luminous intensities of the first fluorescent part (21) and the second fluorescent part (22) were measured to give only the difference of about ±10%.

In Example 2, the fluorescent materials used for the first fluorescent part (21) for the reference white color are the same with the P-22 fluorescent materials of the second fluorescent part (22) except the red fluorescent materials and the green fluorescent materials. Accordingly, the luminous spectrum of the red fluorescent materials and the luminous spectrum of the green fluorescent materials are similar to but not the same with those of the fluorescent materials used in the second fluorescent part (22). However, in the case of the color cathode ray tube using the first fluorescent part of Example 2, the white balance adjustment could be easily attained in high accuracy as these of Example 1.

The color cathode ray tube was prepared by using the mixture of the fluorescent materials prepared by combining the red, the green and the blue fluorescent material (P-22).

For example, the first fluorescent part (21) for the reference white color was prepared by blending suitable red, green and blue fluorescent materials selected from $Y_2O_3$:Eu, $YVO_4$:Eu and $Y_2O_2S$:Eu as the red fluorescent material; (Zn, Cd)S:Cu:Al, ZnS:Al:Cu and ZnS:Cu:Au:Al as the green fluorescent material and ZnS:Ag as the blue fluorescent material, and then, the color comparison with the second fluorescent part (22) was carried out. In all of the combinations, the white balance adjustment could be simply attained in high accuracy as the same with those of Example 2.

In said example, the secondary fluorescent part (22) was prepared by using $Y_2O_3$:Eu as the red fluorescent materials; (Zn, Cd)S:Cu:Al as the green fluorescent materials and ZnS:Ag as the blue fluorescent materials.

The similar excellent results could be attained by using the P-22 fluorescent materials in the other combinations.

In the preparation of the fluorescent screen of the color cathode ray tube of the present invention, it has been found to be difficult to obtain uniform fluorescent screen without a gap at the boundary between the first fluorescent part (21) and the second fluorescent part (22). If a gap is formed at the boundary between both of the fluorescent parts, the appearance is inferior to reduce the value as the product. Moreover, the gap causes an eyesore whereby the accuracy of the color comparison is caused.

It is possible to superpose both of the fluorescent parts at the boundary to eliminate the gap. However, the superposed part imparts a luminous color being different from the reference white color for the first fluorescent part (21) disadvantageously.

In the other embodiment of the present invention, the trouble of the difference of the luminous color at the boundary is eliminated to give high accuracy in the color comparison.

In the embodiment of the color cathode ray tube, in order to prevent the trouble, a light absorbing zone having a width of about 1 to 2 mm is formed at the boundary between both of the fluorescent parts.

Figure 4:
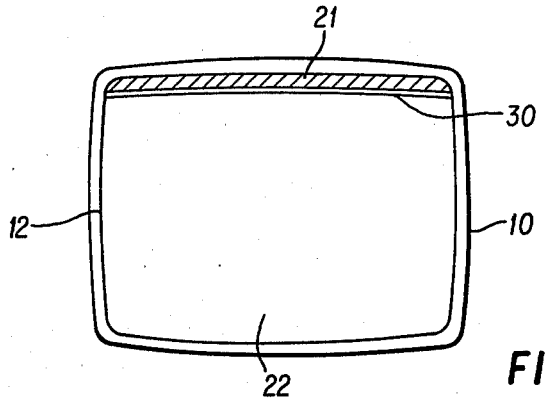
FIG. 4 is a schematic view of the other embodiment of a color cathode ray tube of the present invention by a sight from the front of a face plate wherein a light absorbing zone is provided at the boundary between the first fluorescent part for the reference white color and the second fluorescent part for tricolor dots or tricolor stripes.

FIG. 4 shows the structure of the face plate of the color cathode ray tube of the present invention which comprises the light absorbing zone.

In the color cathode ray tube of FIG. 4, the screen (12) comprises the first fluorescent part (21) for the reference white color and the second fluorescent part (22) for red, green and blue tricolor dots or tricolor stripes and the light absorbing line having a width of 1 to 2 mm (30) at the boundary between the first fluorescent part (21) and the second fluorescent part (22).

When the white balance adjustment was carried out by using the color cathode ray tube having the light absorbing line (30) at the boundary, the color adjustment by the color comparison is easily attained in high accuracy to obtain advantageous results in comparison with the embodiments having a gap at the boundary between the fluorescent parts or the embodiment having superposed fluorescent parts.

A black light absorbing materials used for a black matrix type color cathode ray tube such as graphite and manganese dioxide can be used as the material for the light absorbing line (30). The light absorbing line (30) can be prepared by the method of preparing the black matrix in the black matrix type color cathode ray tube. Accordingly, it is not necessary to equip a new apparatus nor to use a new material and it is possible to prepare the screen of the present invention by using the conventional apparatus and materials.

The present invention will be further illustrated by certain examples.

EXAMPLE

A photoresist composition comprising polyvinyl alcohol and bichromate was coated on an inner surface of a face plate. The part corresponding to the light absorbing zone (30) shown on a shadow mask was covered with a light absorbing material. The photoresist composition on the face plate was exposed by ultraviolet rays through the shadow mask at the positions for the red, blue and green luminous elements. The unexposed parts were developed and washed off and suspension of graphite was coated on it and was dried. An oxidizing agent such as hydrogen peroxide solution was charged to remove the graphite and the photoresist composition from the exposed parts, whereby the light absorbing zone can be formed. It is possible to form the black-matrix type color cathode ray tube wherein the outer parts of the red, blue and green luminous elements are covered with the light absorbing material, by selecting suitable exposure in said exposing step.

Then, a black tape was peeled off and the shadow mask was covered with the other black tape from the central part of the black tape to the first fluorescent part (21) for the reference white color. Each of photosensitive slurries of red, blue or green fluorescent materials for the second fluorescent part (22) was sequentially applied under exposing through the shadow mask and developing them to form the tricolor luminous elements to form the second fluorescent part (22). In said step, no material was coated at the first fluorescent part (21). The black tape was again peeled off, and the whole part of the shadow mask beside the part covered with the black tape, was covered with the other light absorbing tape. A photosensitive slurry of the reference white color fluorescent materials was applied and the membrane was exposed through the shadow mask and developed to form the first fluorescent part (21).

The color cathode ray tube of the present invention having the light absorbing line (30) shown in FIG. 4 can be prepared by the following steps for the preparation of the conventional color cathode ray tube.

As described above, in the color cathode ray tube of the present invention, the first fluorescent part for the reference white color is formed at a part of the screen and the white balance adjustment is attained by controlling the chromaticities of the tricolor dots or tricolor stripes to the luminous white color of the first fluorescent part for the reference white color so as to precisely adjust to the predetermined reference white color in the white balance adjustment of the monitor color cathode ray tube used in the broadcasting stations.

In accordance with the color cathode ray tube of the present invention, the white balance adjustment can be easily attained in high accuracy to the predetermined reference white color without using the other reference white light source, a white balancer adjuster nor a chromaticity thermometer.

The first fluorescent part for the reference white color is provided on the same screen for the second fluorescent part for the tricolor dots or tricolor stripes whereby the color comparison can be attained in one sight and the color comparison can be easily attained in high accuracy as described above.

The fluorescent material used for the first fluorescent part for the reference white color is a mixture of the red, green and blue fluorescent materials used for the second fluorescent part for the tricolor dots or tricolor stripes (P-22) or a mixture of red, green and blue fluorescent materials at suitable ratios (mainly selected from P-22) whereby the luminous spectrum of the first fluorescent part for the reference white color is substantially the same with that of the second fluorescent part for the tricolor dots or tricolor stripes and the luminous intensities of both of the fluorescent parts are substantially the same. Accordingly, the accuracy of the color comparison is advantageously remarkably high in the white balance adjustment.

In accordance with the other embodiment of the color cathode ray tube of the present invention, the light absorbing zone is formed at the boundary between both of the fluorescent parts to eliminate the gap or the superposing at the boundary between both of the fluorescent parts and to further increase the accuracy of the color comparison.

In accordance with the color cathode ray tube of the present invention, the white balance adjustment for adjusting the white color of the monitor color cathode ray tube to the predetermined reference white in high accuracy. The white balance adjustment can be attained without a skill in simple manner whenever the operator wish.

In the color cathode ray tubes shown in FIGS. 1 and 4, the first fluorescent part (21) for the reference white color is provided at the upper edge of the screen (12). However, the first fluorescent part (21) can be provided at the lower edge of the screen (12) or at right or left edge of the screen. That is, the first fluorescent part (21) can be provided at any optional part on the screen (12)

and the position and number of the first fluorescent part (21) are not limited to those of the embodiment shown in FIGS. 1 and 4.

The color cathode ray tube of the present invention is illustrated as the monitor color cathode ray tube used in the broadcasting stations, however it can be also used for the white balance adjustment of a receiver in a manufacture or for various industrial apparatuses having the reference white.

In the description, three reference white colors of D9300, D6500 and 9300° K.+27MCPD have been shown. Thus, the reference white color of the first fluorescent part (21) of the color cathode ray tube of the present invention can be the other reference white color having different chromaticity point. The reference white color is not limited to the three reference white colors.

What is claimed is:

1. In a color cathode ray tube having on an inner surface of a face plate a first fluorescent part for luminescence of a predetermined reference white color by irradiation with electron beams from three tricolor electron guns, and a second fluorescent part for luminescence of red, green and blue fluorescent tricolor dots or tricolor stripes on the remainder of the face plate, an improvement comprising:

the first fluorescent part for the reference white color formed of a blended mixture of the tricolor fluorescent materials used for the second fluorescent part which imparts said reference white color upon irradiation with electron beams from said three tricolor electron guns.

2. A color cathode ray tube according to claim 1 wherein the fluorescent material of the first fluorescent part for the reference white color is a mixture of red, green and blue fluorescent materials selected from the red, green and blue fluorescent materials for P-22 fluorescent materials.

3. A color cathode ray tube according to claim 2 wherein the first fluorescent part for the reference white color is formed by using a mixture of $Y_2O_3$:Eu as a red fluorescent material, (Zn, Cd)S:Cu:Al as a green fluorescent material and ZnS:Ag as a blue fluorescent material at ratios of about 1.0:0.95:0.81.

4. A color cathode ray tube according to claim 2 wherein the first fluorescent part for the reference white color is formed by using mixture of $Y_2O_2S$:Eu as a red fluorescent material, Zn:Al:Cu as a green fluorescent material and ZnS:Ag as a blue fluorescent material at ratios of about 1.0:0.58:0.47.

5. A color cathode ray tube according to claim 2 wherein the first fluorescent part for the reference white color is formed by using a mixture of a red fluorescent material selected from $Y_2O_3$:Eu, $YVO_4$:Eu and $Y_2O_2S$:Eu; and a green fluorescent material selected from (Zn, Cd) S:Cu:Al, ZnS:Al:Cu and ZnS:Cu:Au:Al; and a blue fluorescent material of ZnS:Ag.

6. A color cathode ray tube according to claim 1 wherein a light absorbing zone is formed at a boundary between the first fluorescent part and the second fluorescent part.

7. A color cathode ray tube according to claim 6 wherein the light absorbing zone is formed by coating graphite or manganese dioxide.

8. A color cathode ray tube according to claim 1 wherein the first flourescent part for the reference white color is provided at an effective display part selected from an upper edge, a lower edge, a right edge and a left edge on the face plate.

9. In a color cathode ray tube having on an inner surface of a face plate a first fluorescent part for luminescence of a predetermined reference white color by irradiation with electron beams from three tricolor electron guns, and a second fluorescent part for luminescence of red, green and blue fluorescent tricolor dots or tricolor stripes on the remainder of the face plate, an improvement comprising:

the first fluorescent part for the reference white color formed of a blended mixture of tricolor fluorescent materials which imparts said reference white color upon irradiation with electron beams from said three tricolor electron guns.

* * * * *